US010150350B2

(12) United States Patent
Jeon et al.

(10) Patent No.: US 10,150,350 B2
(45) Date of Patent: Dec. 11, 2018

(54) VEHICLE HEAT EXCHANGER

(71) Applicant: Hanon Systems, Daejeon (KR)

(72) Inventors: Young-Ha Jeon, Daejeon (KR); Jung Sam Gu, Daejeon (KR); Hyun Kun Shin, Daejeon (KR); Kwang Hun Oh, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 15/528,997

(22) PCT Filed: Mar. 16, 2016

(86) PCT No.: PCT/KR2016/002650

§ 371 (c)(1),
(2) Date: May 23, 2017

(87) PCT Pub. No.: WO2016/148508

PCT Pub. Date: Sep. 22, 2016

(65) Prior Publication Data

US 2018/0029446 A1 Feb. 1, 2018

(30) Foreign Application Priority Data

Mar. 19, 2015 (KR) ..... 10-2015-0038218

(51) Int. Cl.

| | |
|---|---|
| ***B60H 1/32*** | (2006.01) |
| ***F28F 9/02*** | (2006.01) |
| ***F28D 1/053*** | (2006.01) |
| ***F28D 21/00*** | (2006.01) |

(52) U.S. Cl.

CPC ..... *B60H 1/3227* (2013.01); *F28D 1/05391* (2013.01); *F28F 9/0202* (2013.01);
(Continued)

(58) Field of Classification Search

CPC ..... B60H 1/3227; F28D 1/05391; F28D 2021/0085; F28D 1/0417; F28D 1/047;
(Continued)

(56) References Cited

U.S. PATENT DOCUMENTS

| | | | | |
|---|---|---|---|---|
| 5,078,208 | A * | 1/1992 | Urch | F24F 12/001 165/166 |
| 2003/0066633 | A1* | 4/2003 | Lee | F25B 39/02 165/144 |
| 2008/0169085 | A1* | 7/2008 | Oh | F28D 1/05391 165/70 |
| 2009/0114379 | A1* | 5/2009 | Lim | B23P 15/26 165/151 |
| 2010/0243223 | A1* | 9/2010 | Lim | F25B 39/022 165/173 |

(Continued)

FOREIGN PATENT DOCUMENTS

| | | |
|---|---|---|
| JP | 2005308384 A | 11/2005 |
| KR | 1998-050607 | 10/1998 |

(Continued)

OTHER PUBLICATIONS

International Search Report issued in PCT/KR2016/002650 dated Jul. 22, 2016.

*Primary Examiner* — Justin M Jonaitis
(74) *Attorney, Agent, or Firm* — James R. Crawford; Norton Rose Fulbright US LLP

(57) ABSTRACT

The present invention relates to a heat exchanger for a vehicle, in which a refrigerant is introduced into a first row heat exchanger and a second row heat exchanger and flows in opposite directions, thereby improving uniformity of temperature distribution.

8 Claims, 13 Drawing Sheets

(52) U.S. Cl.
CPC ..... *F28F 9/0204* (2013.01); *F28F 9/026* (2013.01); *F28F 9/028* (2013.01); *F28F 9/0224* (2013.01); *F28D 2021/0085* (2013.01); *F28F 9/0212* (2013.01); *F28F 2250/102* (2013.01)

(58) Field of Classification Search
CPC ..... F28D 1/05308; F28D 1/05316; F28D 1/05358; F28D 1/05366; F28F 9/0202; F28F 9/0204; F28F 9/0224; F28F 9/026; F28F 9/028; F28F 9/0212; F28F 2250/102
USPC ..... 165/150, 148, DIG. 341, DIG. 427, 165/DIG. 430, DIG. 471
See application file for complete search history.

(56) References Cited

U.S. PATENT DOCUMENTS

| | | | | |
|---|---|---|---|---|
| 2011/0083466 | A1* | 4/2011 | Lim | B60H 1/00335 62/498 |
| 2011/0100614 | A1* | 5/2011 | Oh | F28D 1/05391 165/173 |
| 2013/0312455 | A1* | 11/2013 | Jeon | F28D 1/0435 62/525 |

FOREIGN PATENT DOCUMENTS

| | | | |
|---|---|---|---|
| KR | 100779706 | B1 | 11/2007 |
| KR | 20090048352 | A | 5/2009 |
| KR | 20120010357 | A | 2/2012 |
| KR | 20130024733 | A | 3/2013 |

* cited by examiner

[Fig. 1]
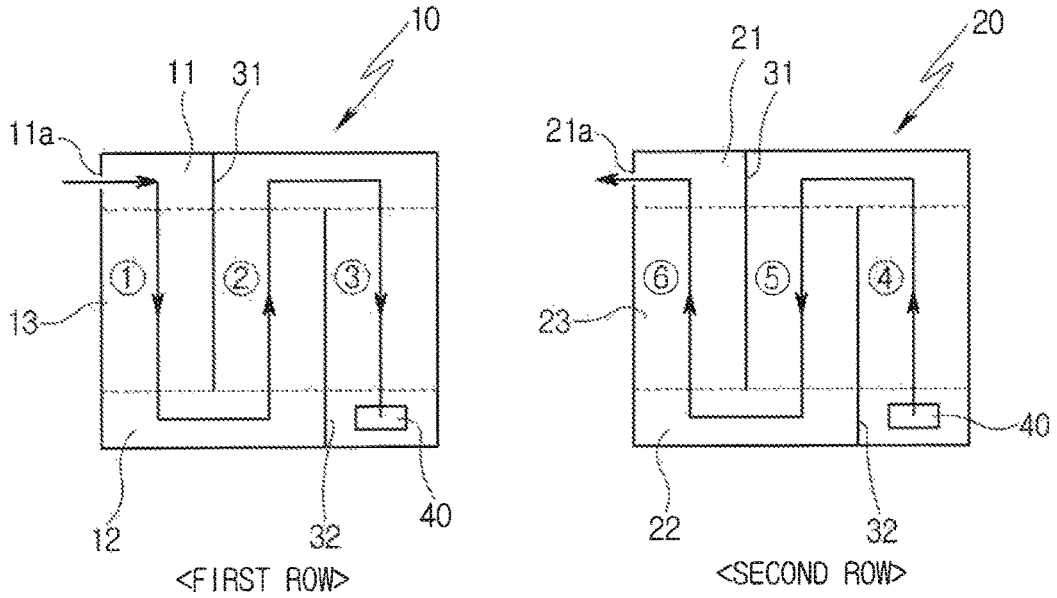

[Fig. 2]
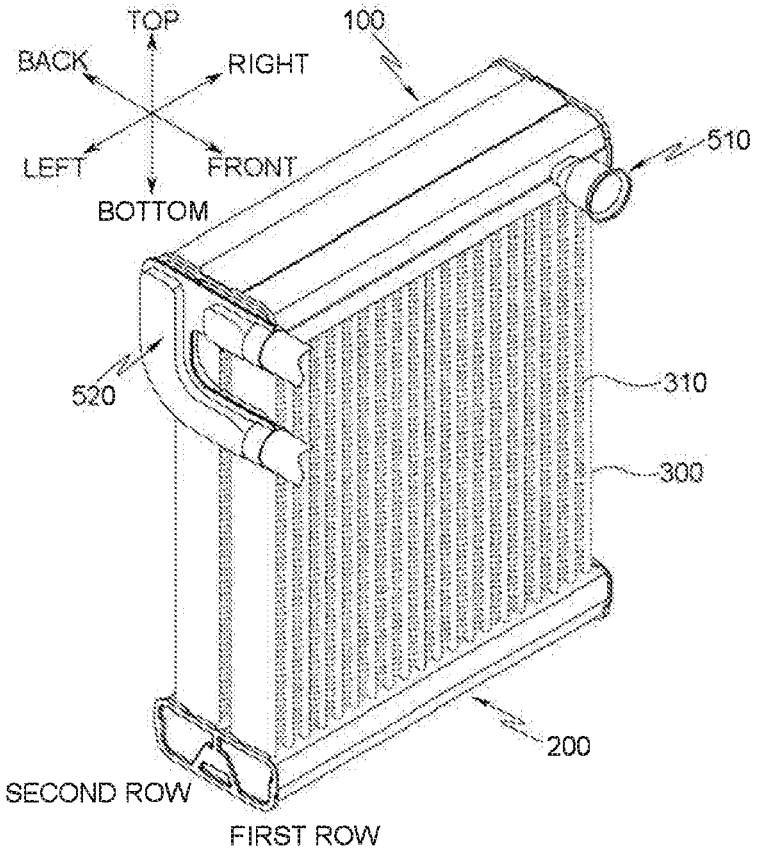

[Fig. 3]
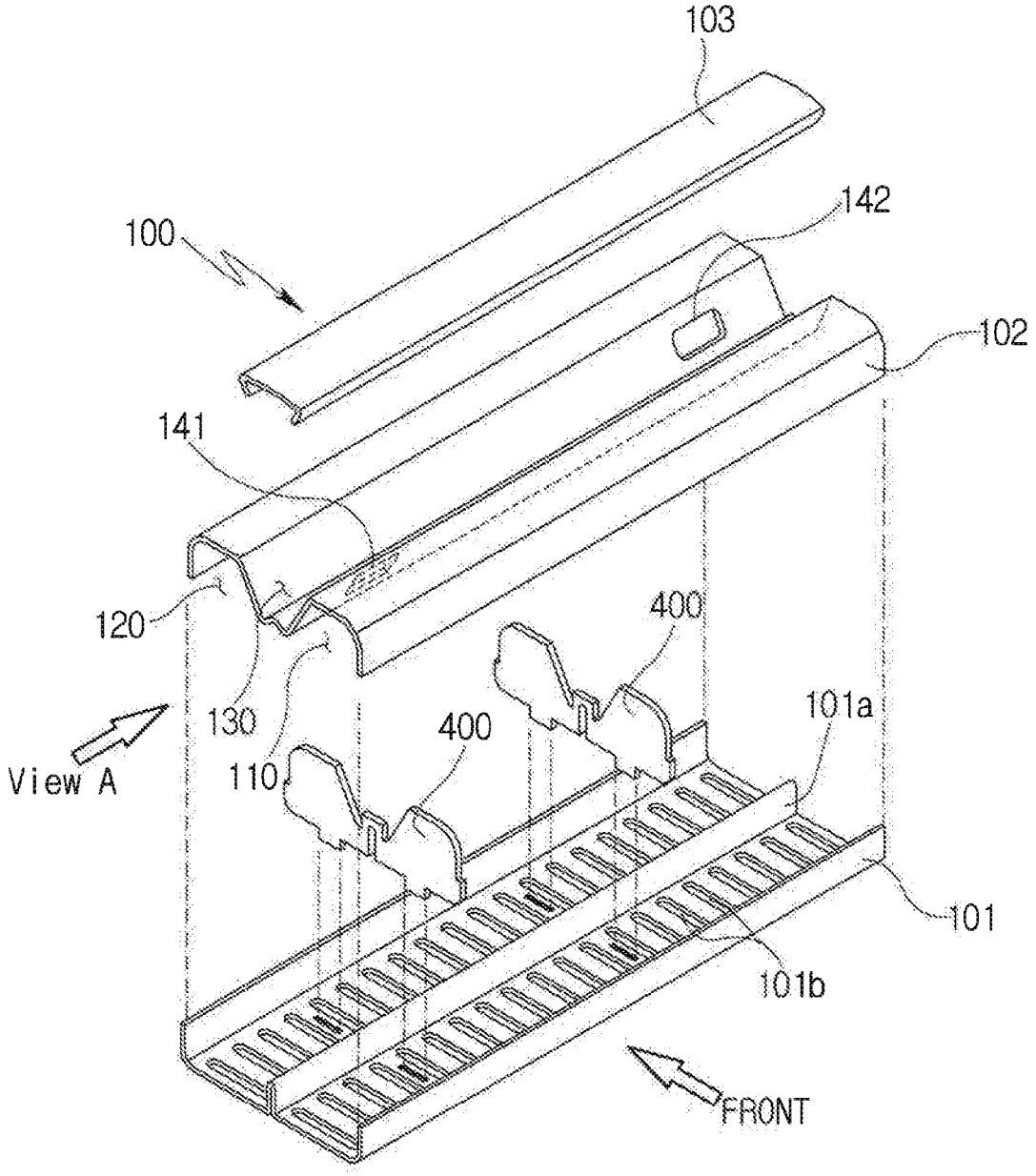

[Fig. 4]
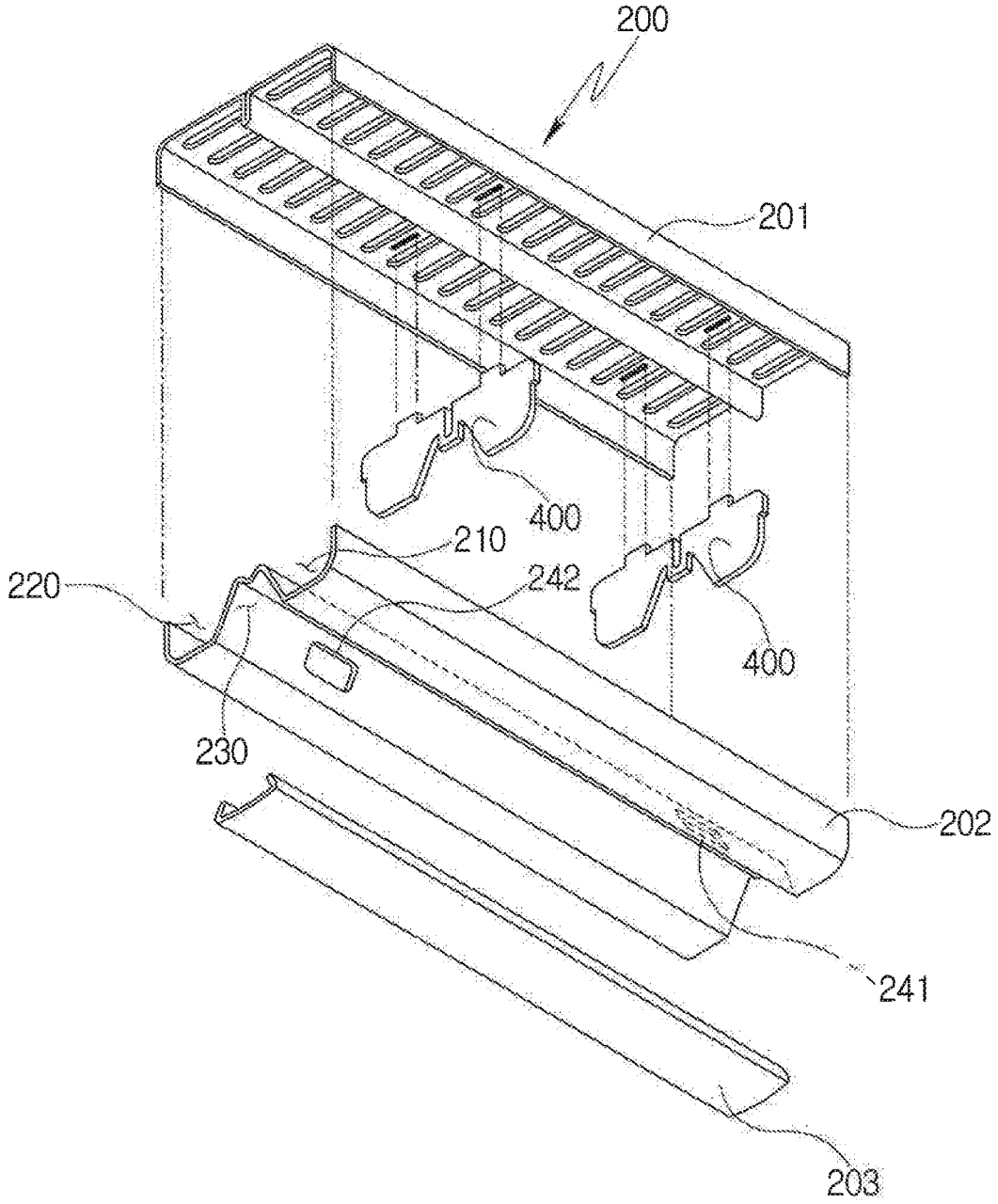

[Fig. 5]
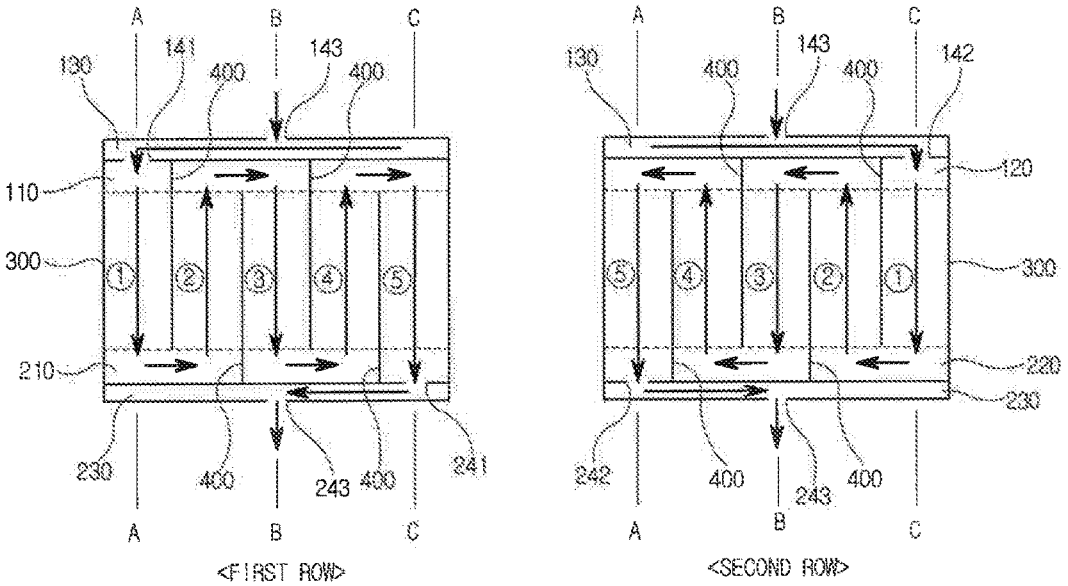

[Fig. 6]
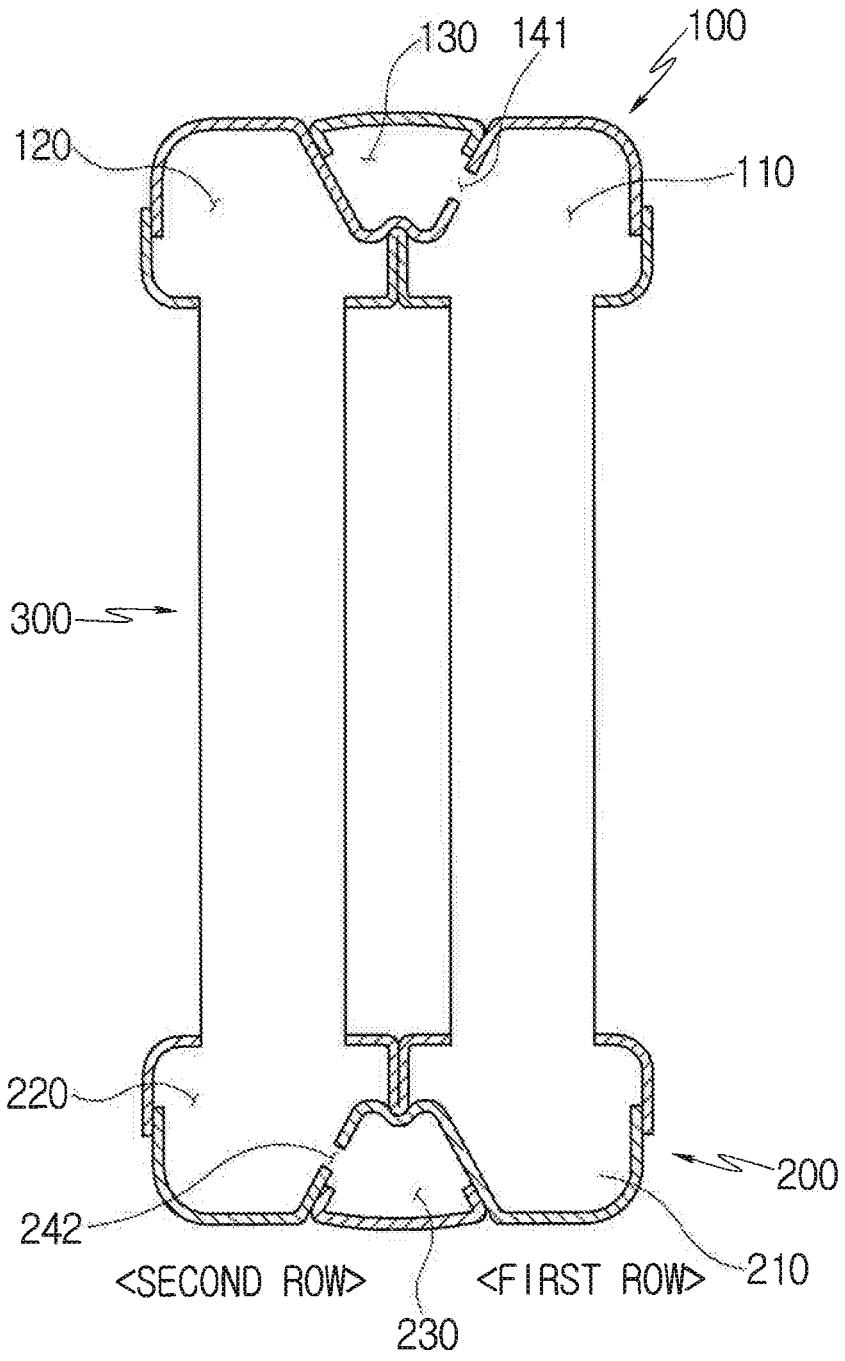
[A-A]

[Fig. 7]
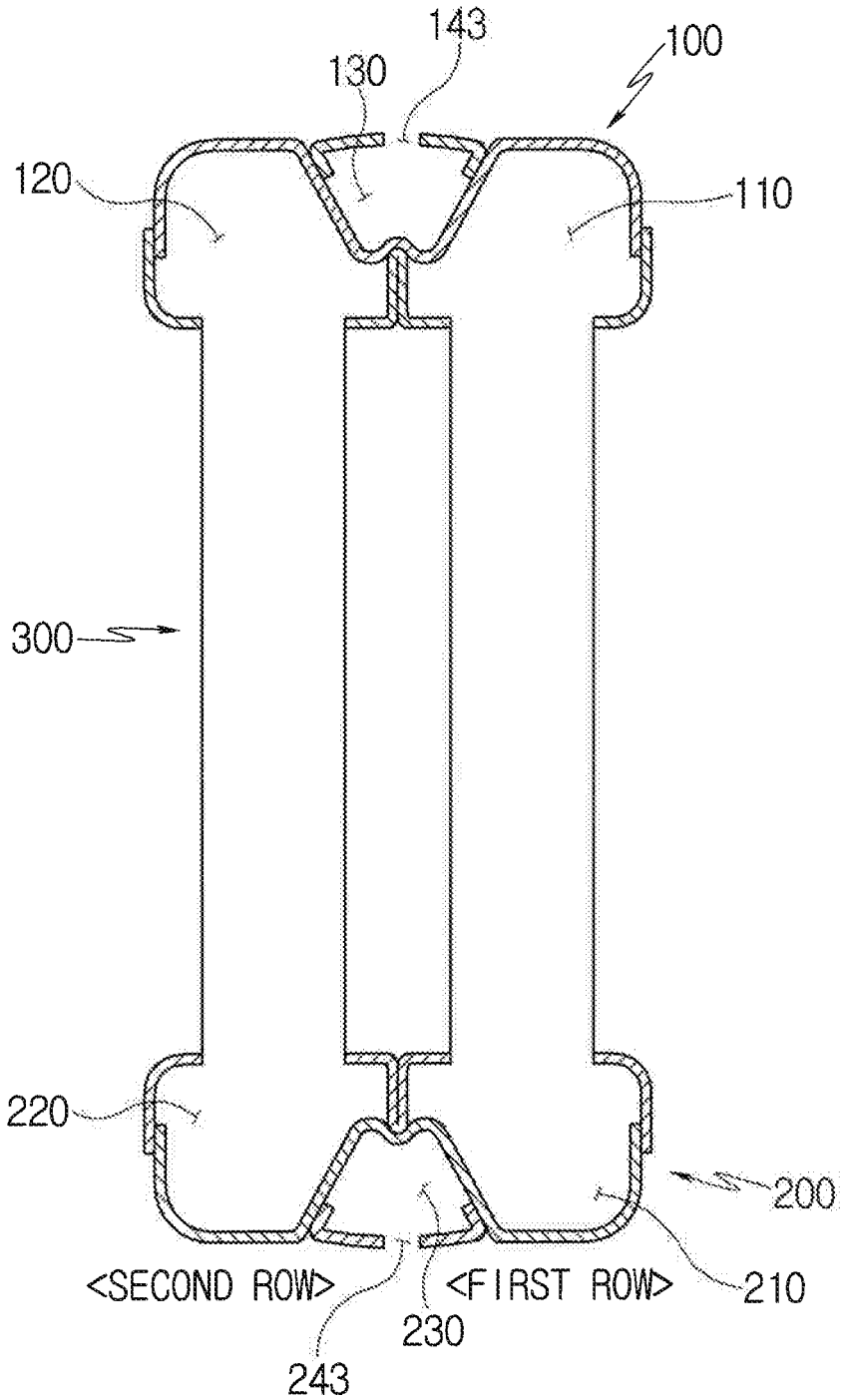
[B-B]

[Fig. 8]
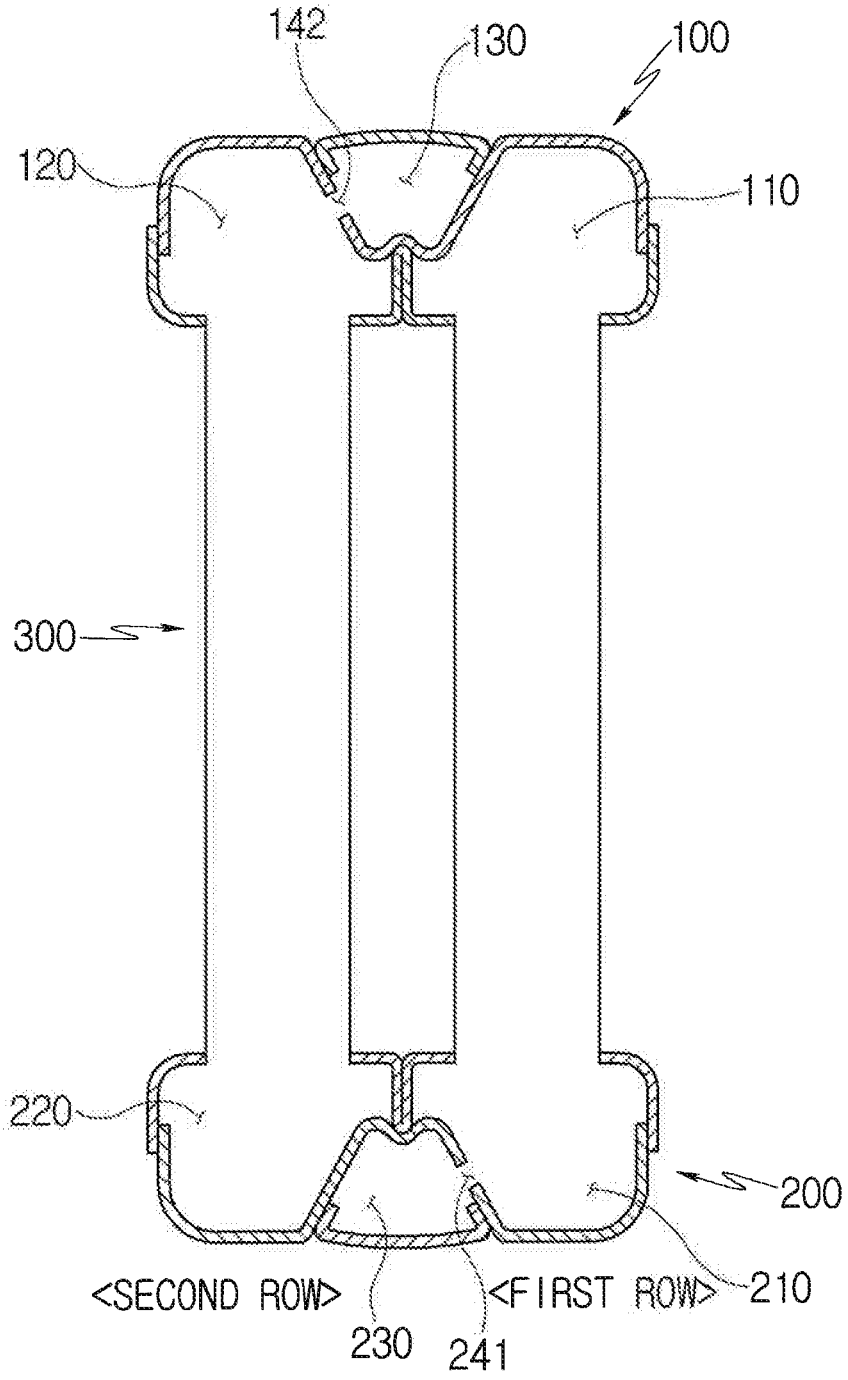
[C-C]

[Fig. 9]
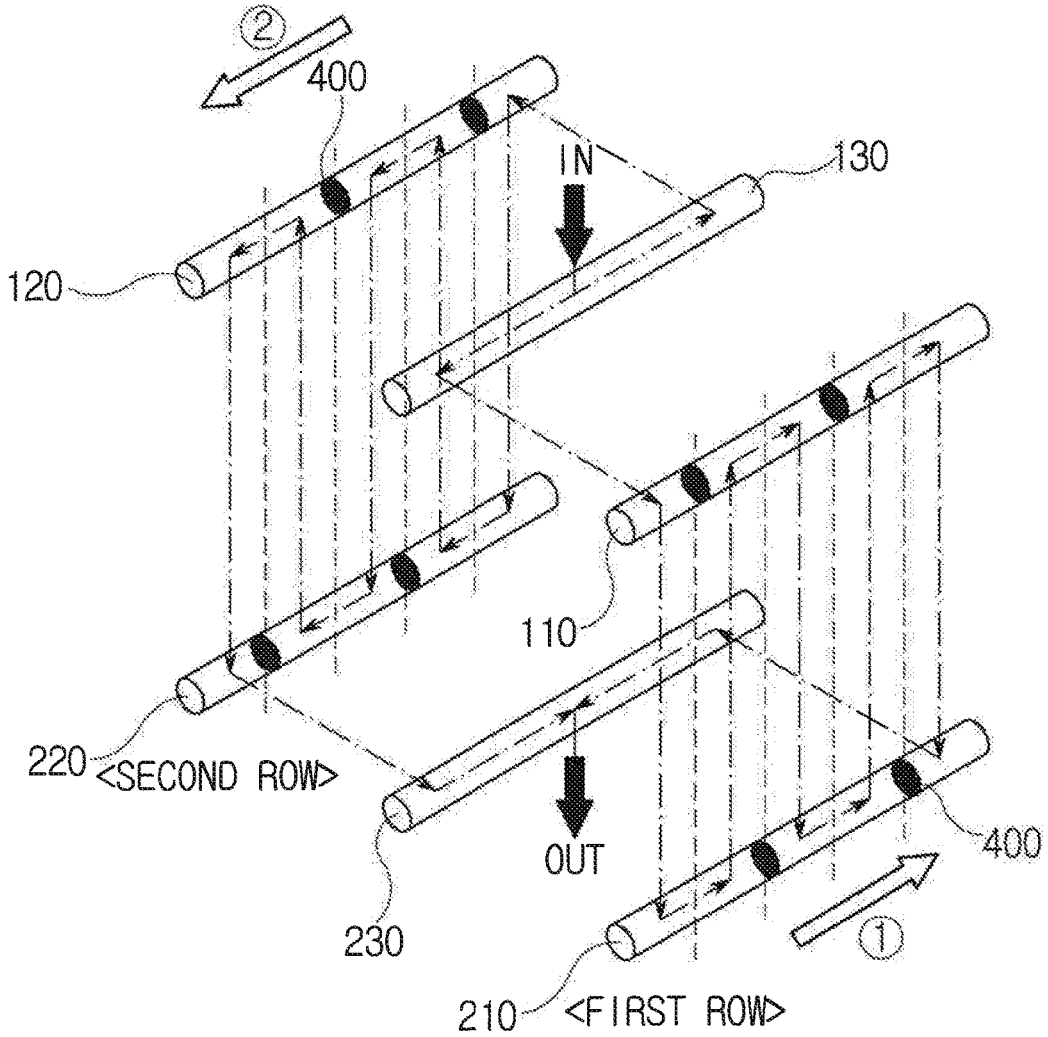

[Fig. 10]
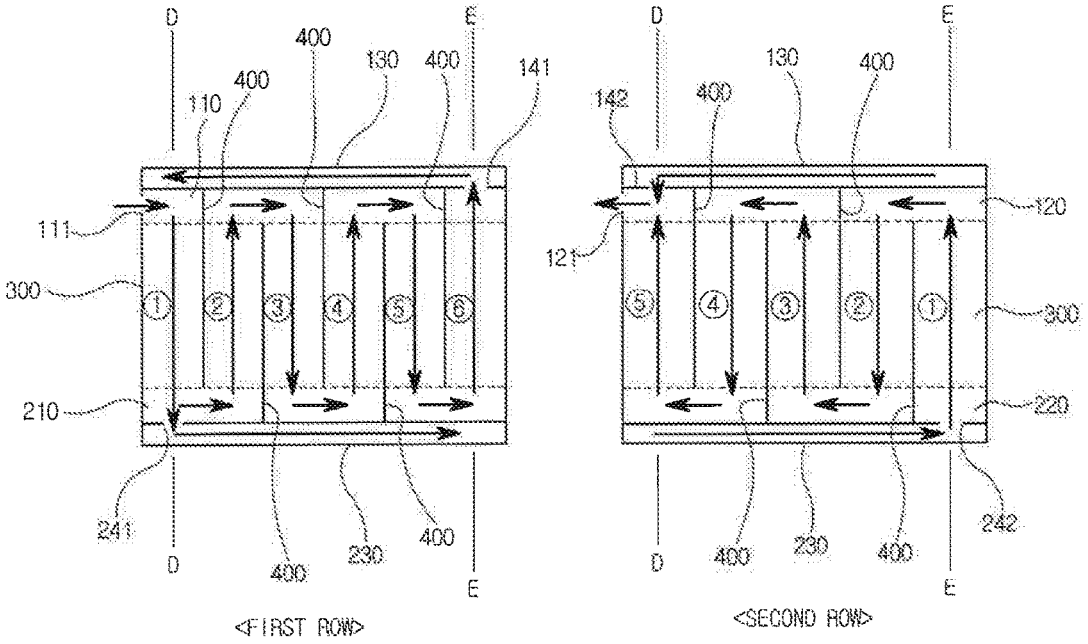

[Fig. 11]
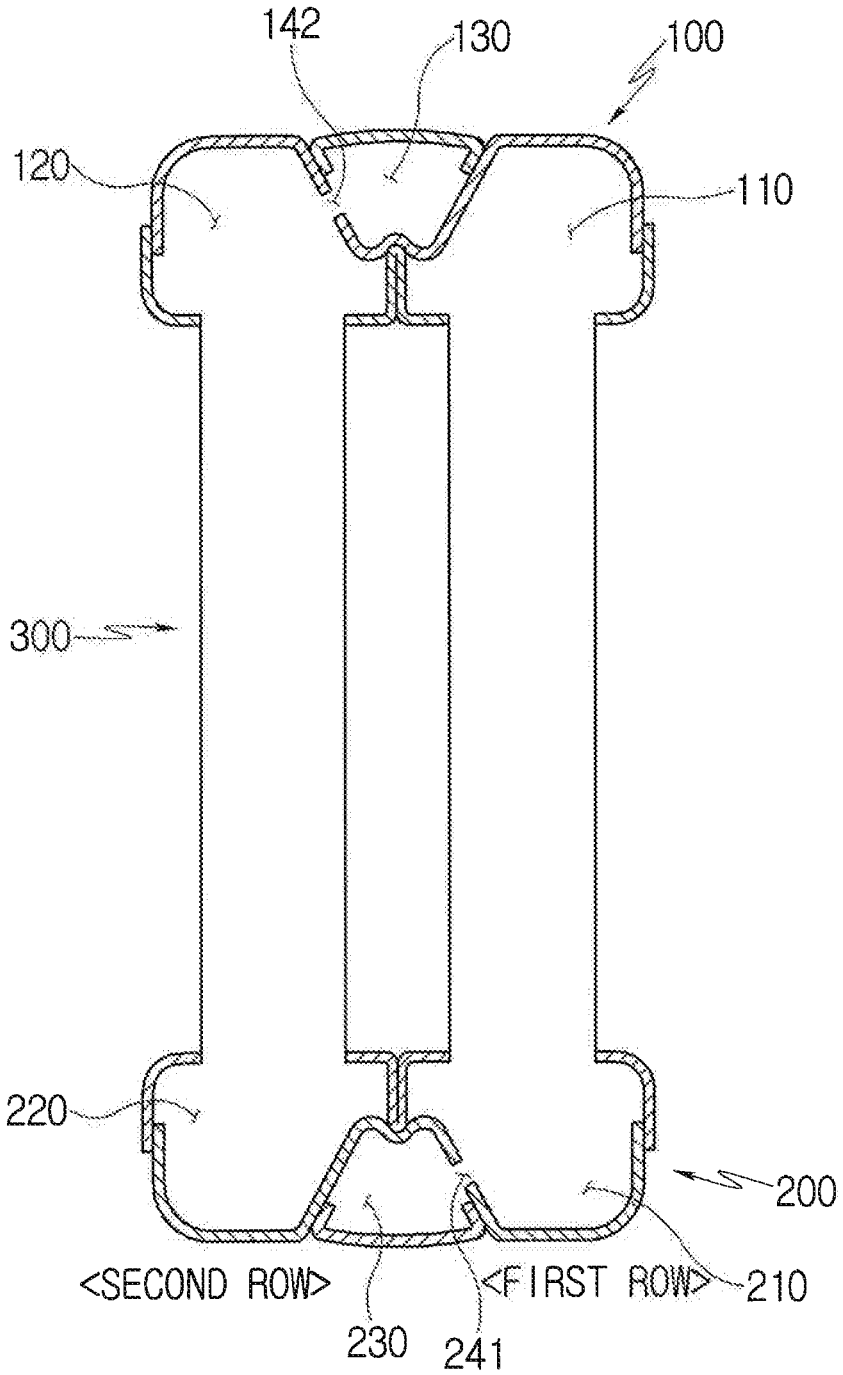
[D-D]

[Fig. 12]
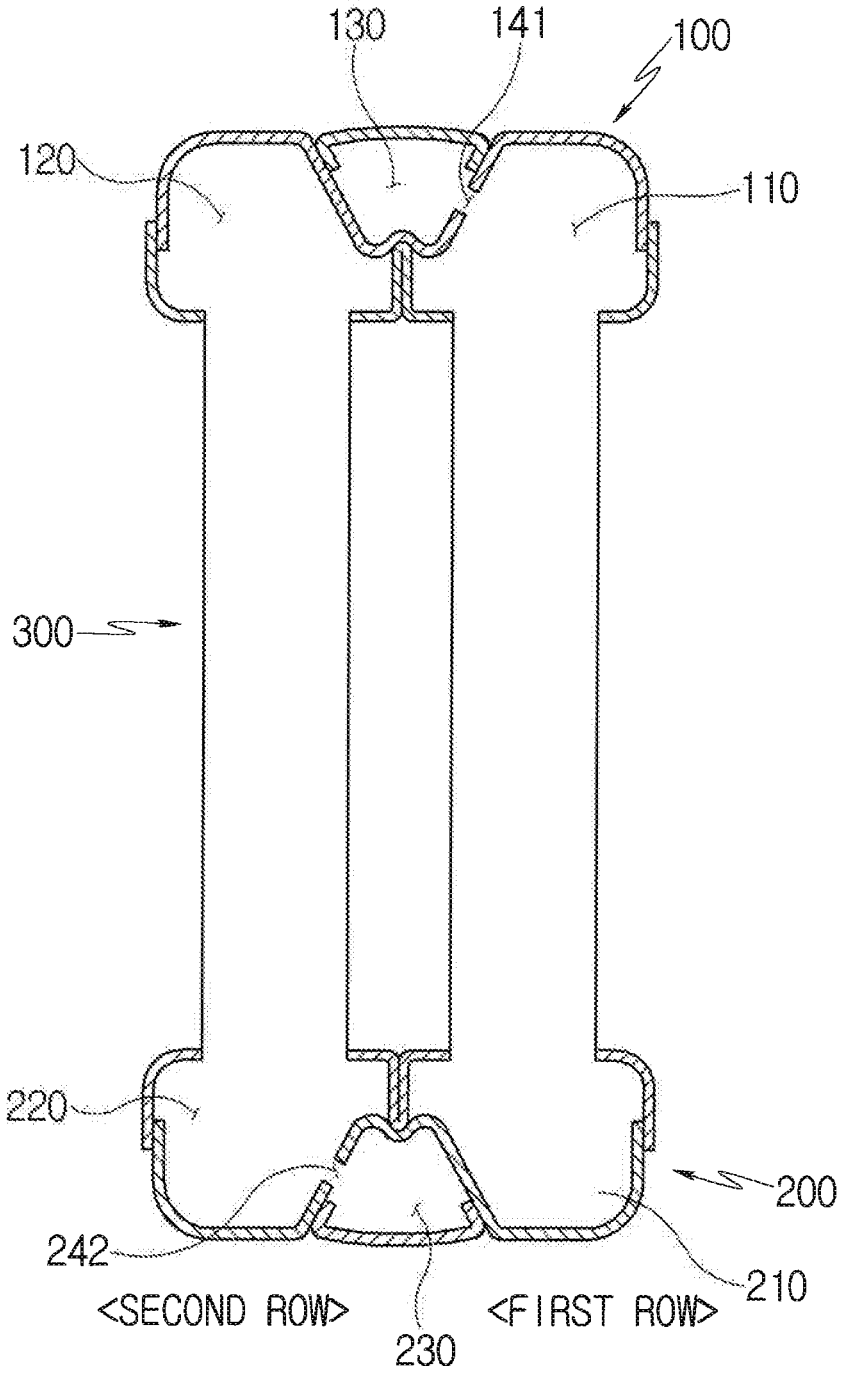
[E-E]

[Fig. 13]
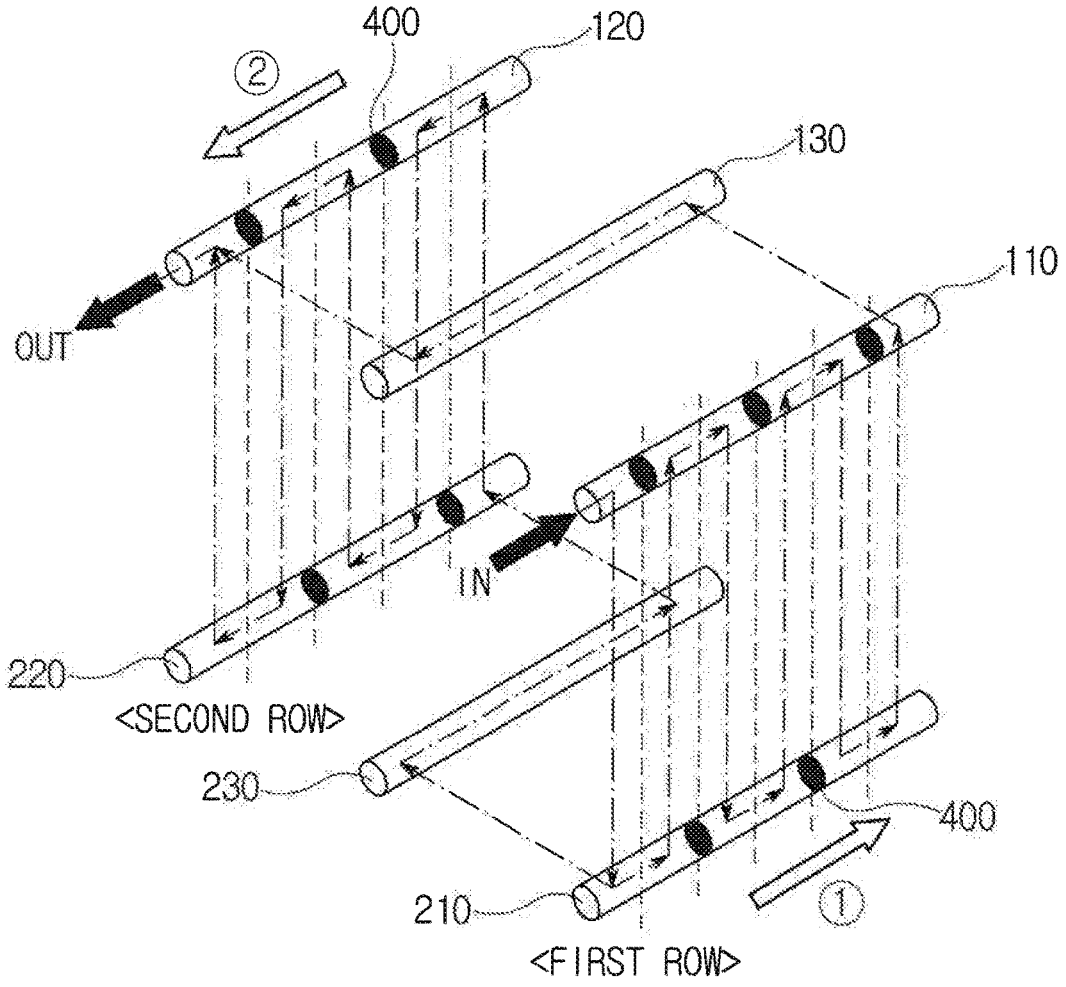

VEHICLE HEAT EXCHANGER

This application is a § 371 of International Application No. PCT/KR2016/002650 filed Mar. 16, 2016, and claims proirity from Korean Patent Application No. 10-2015-0038218 filed Mar. 19, 2015.

TECHNICAL FIELD

The present invention relates to a heat exchanger for a vehicle, and more particularly, to a heat exchanger for a vehicle in which air passing therethrough has a uniform temperature distribution.

BACKGROUND ART

Vehicles are equipped with air conditioners for cooling and dehumidification in the summer.

Air conditioners include compressors, condensers, expansion valves, and evaporators, circulate refrigerant through them, and supply cold air, which is generated by absorbing ambient heat when the refrigerant evaporates in the evaporators, to the interior.

The temperature of air discharged to the interior is preferably uniform regardless of the position of each vent. However, if the temperature in an evaporator is not uniformly distributed, the temperature distribution of air passing through a heat exchanger is not uniform and hence the temperature of discharged air may vary depending on the vents.

Accordingly, it is necessary to uniformize a temperature distribution throughout the area of the evaporator, i.e. the heat exchanger through which air passes.

In recent years, a plurality of rows of heat exchangers is used to help in uniformizing the temperature distribution of air therethrough. Typically, first and second row heat exchangers are installed to overlap each other, and these two heat exchangers form a single system having a single inlet and outlet.

FIG. 1 is a diagram illustrating a plurality of rows of heat exchangers according to the related art, and illustrates that first and second row heat exchangers arranged in forward and backward directions are separated on one plane.

As illustrated in the drawing, each of a first row heat exchanger 10 and a second row heat exchanger 20 includes an upper header tank, a lower header tank, and a plurality of tubes connecting them. The first and second row upper and lower header tanks are partitioned into a first row upper space 11, a second row upper space 21, a first row lower space 12, and a second row lower space 22 by a partition wall that traverses the center portion therein.

Baffles 31 and 32 are installed at predetermined positions in the spaces to block the flow of a refrigerant, so that a plurality of passes having the flow of a refrigerant is formed in the respective spaces. By way of example, a heat exchanger is illustrated to have a total of six flow paths consisting of three passes in a first row and three passes in a second row. A refrigerant inlet 11*a* is formed at one side of the first row upper space 11, a refrigerant outlet 21*a* is formed at one side of the second row upper space 21, and a communication hole 40 for connecting the first and second row lower spaces 12 and 22 therethrough is formed at one side of the partition wall of the lower header tank.

Accordingly, the refrigerant introduced into the refrigerant inlet 11*a* passes through ①, ②, and ③ passes of the first row heat exchanger 10, flows to the second row heat exchanger 20 through the communication hole 40, passes through ④, ⑤, and ⑥ passes, and is then discharged to the refrigerant outlet 21*a*.

However, since the conventional heat exchanger has a series flow structure in which a refrigerant flows to the second row heat exchanger 20 via the first row heat exchanger 10, there are regions (① and ⑥ passes) where a severe variation in temperature occurs among the overlapped passes (① and ⑥, ② and ⑤, and ③ and ④) in the state in which the heat exchanger is installed in the vehicle.

For this reason, the temperature distribution in the heat exchanger may not be uniform, and the temperature distribution of air passing through the heat exchanger may not be uniform.

Korean Patent Application Publication No. 10-1998-0050607 discloses a heat exchanger having an overlapped structure in first and second rows.

DISCLOSURE

Technical Problem

Accordingly, the present invention has been made in view of the above-mentioned problem, and an object thereof is to provide a heat exchanger for a vehicle with improved uniformity of temperature distribution by formation of parallel flow and counter flow of refrigerant in first and second row heat exchangers.

Technical Solution

In accordance with an aspect of the present invention, a heat exchanger for a vehicle includes an upper header tank (100) including a first row upper space (110), a second row upper space (120), and an upper intermediate space (130) having first and second communication holes (141 and 142) formed therebetween, a lower header tank (200) including a first row lower space (210), a second row lower space (220), and a lower intermediate space (230) having first and second communication holes (241 and 242) formed therebetween, a first row heat exchanger formed by connecting the first row upper space (110) to the first row lower space (210) using a plurality of tubes (300), a second row heat exchanger formed by connecting the second row upper space (120) to the second row lower space (220) using a plurality of tubes (300), and a plurality of baffles (400) installed in the first row upper space (110), the second row upper space (120), the first row lower space (210), and the second row lower space (220) to form refrigerant passes, wherein a parallel flow is formed in which a refrigerant is distributed to the first row heat exchanger and the second row heat exchanger, and a counter flow is formed in which the refrigerant flowing from an introduction port to a discharge port flows in opposite directions in each of the first row heat exchanger and the second row heat exchanger.

The introduction port may be a refrigerant inlet (143) formed in the upper intermediate space (130), the discharge port may be a refrigerant outlet (243) formed in the lower intermediate space (230), the refrigerant may be introduced into the refrigerant inlet (143) and then be distributed to and introduced into the first row upper space (110) and the second row upper space (120) through the first and second communication holes (141 and 142) formed at opposite sides in the upper intermediate space (130), and the distributed refrigerants may flow in opposite directions in the first row heat exchanger and the second row heat exchanger to flow to the first row lower space (210) and the second row lower space (220), be introduced from the first row lower space (210) and the second row lower space (220) into the lower intermediate space (230) through the first and second communication holes (241 and 242) formed at opposite sides in the lower intermediate space (230), and be discharged through the refrigerant outlet (243).

The refrigerant inlet (143) may be formed at one side of an upper portion in the upper intermediate space (130), and the refrigerant outlet (243) may be formed at one side of a lower portion in the lower intermediate space (230).

Alternatively, the refrigerant inlet (143) may be formed at any one of both sides in the upper intermediate space (130), and the refrigerant outlet (243) may be formed at any one of both sides in the lower intermediate space (230).

The baffles (400) may be alternately installed at a certain distance in the first row upper space (110) and the first row lower space (210) in the first row heat exchanger so that the same number of baffles is installed in the first row upper space (110) and the first row lower space (210) to form odd refrigerant passes, and the baffles (400) may be alternately installed at a certain distance in the second row upper space (120) and the second row lower space (220) in the second row heat exchanger so that the same number of baffles is installed in the second row upper space (120) and the second row lower space (220) to form odd refrigerant passes.

The introduction port may be a refrigerant inlet (111) formed in the upper intermediate space (130), the discharge port may be a refrigerant outlet (121) formed in the lower intermediate space (230), the refrigerant may be introduced into the refrigerant inlet (111) and flow downward to the first row lower space (210) through a first pass of the first row heat exchanger, a portion of the refrigerant may flow in one direction along refrigerant passes of the first row heat exchanger to flow upward to the first row upper space (110), flow to the upper intermediate space (130) through the first communication hole (141) formed at one side in the upper intermediate space (130), be introduced into the second row upper space (120) through the second communication hole (142) formed at an opposite side in the upper intermediate space (130), and then be discharged to the refrigerant outlet (121) formed in the second row upper space (120), and the remainder of the refrigerant may be introduced into the lower intermediate space (230) through the first communication hole (241) formed at one side in the lower intermediate space (230), be introduced into the second row heat exchanger through the second communication hole (242) formed at an opposite side in the lower intermediate space (230) to flow along refrigerant passes of the second row heat exchanger in a direction opposite to the refrigerant flow in the first row heat exchanger, and then flow upward to the second row upper space (120) to be discharged through the refrigerant outlet (121).

The refrigerant inlet (111) and the refrigerant outlet (121) may be formed at the same side in the first row upper space (110) or the second row upper space (120).

The baffles (400) may be alternately installed at a certain distance in the first row upper space (110) and the first row lower space (210) in the first row heat exchanger so that one more baffles are installed in the first row upper space (110), compared to the first row lower space (210), to form even refrigerant passes, and the baffles (400) may be alternately installed at a certain distance in the second row upper space (120) and the second row lower space (220) in the second row heat exchanger so that the same number of baffles is installed in the second row upper space (120) and the second row lower space (220) to form odd refrigerant passes.

Advantageous Effects

In accordance with the present invention described above, a parallel flow is formed in which a refrigerant is distributed to and introduced into first and second row heat exchangers in opposite directions therein, and a counter flow is formed in which the refrigerant flows in opposite directions in the first and second row heat exchangers. Therefore, a variation in temperature can be reduced in an overlapped region of the first and second row heat exchangers.

Accordingly, the temperature distribution in the heat exchanger is uniformized and thus the temperature distribution of air passing through the heat exchanger is uniformized. Therefore, cold air with a uniform temperature can be discharged to the interior regardless of the position of each vent.

BRIEF DESCRIPTION OF DRAWINGS

FIG. 1 is a diagram illustrating a heat exchanger according to the related art.

FIG. 2 is a perspective view illustrating a heat exchanger with a double row structure according to the present invention.

FIG. 3 is an exploded perspective view illustrating an upper header tank of the heat exchanger according to the present invention.

FIG. 4 is an exploded perspective view illustrating a lower header tank of the heat exchanger according to the present invention.

FIG. 5 is a diagram illustrating a configuration and a refrigerant flow of a heat exchanger according to a first embodiment of the present invention.

FIGS. 6 to 8 are cross-sectional views of the heat exchanger according to the first embodiment, wherein FIG. 6 is a cross-sectional view taken along line A-A of FIG. 5, FIG. 7 is a cross-sectional view taken along line B-B of FIG. 5, and FIG. 8 is a cross-sectional view taken along line C-C of FIG. 5.

FIG. 9 is a view schematically illustrating the refrigerant flow in the first embodiment in three dimensions.

FIG. 10 is a diagram illustrating a configuration and a refrigerant flow of a heat exchanger according to a second embodiment of the present invention.

FIGS. 11 and 12 are cross-sectional views of the heat exchanger according to the second embodiment, wherein FIG. 11 is a cross-sectional view taken along line D-D of FIG. 10, and FIG. 12 is a cross-sectional view taken along line E-E of FIG. 10.

FIG. 13 is a view schematically illustrating the refrigerant flow in the second embodiment in three dimensions.

BEST MODE FOR INVENTION

The present invention may be embodied in different forms and should not be construed as limited to the embodiments set forth herein. The specific exemplary embodiments of the present invention will be described herein in detail with reference to the accompanying drawings of the exemplary embodiments of the present invention. However, the present invention will not be limited only to the specific exemplary embodiments of the present invention which are disclosed herein. Therefore, it should be understood that the scope and spirit of the present invention can be extended to all variations, equivalents, and replacements in addition to the accompanying drawings of the present invention. In the drawings, the thickness of each line or the size of each component may have been exaggerated, omitted, or schematically illustrated for convenience of description and clarity.

In addition, the terms used in the specification are terms defined in consideration of functions of the present invention, and these terms may vary with the intention or practice of a user or an operator. Therefore, these terms should be defined based on the entire content disclosed herein.

Hereinafter, exemplary embodiments of the present invention will be described in detail with reference to the accompanying drawings.

As illustrated in FIG. 2, a heat exchanger for a vehicle according to the present invention includes an upper header tank 100, a lower header tank 200, tubes 300 connecting them, and cooling fins 310 installed between the tubes 300.

Each of the upper and lower header tanks 100 and 200 has a three-space structure that includes a first row space, a second row space, and an intermediate space between the first and second row spaces.

Each of the header tanks may have an inlet or an outlet that is formed at one side of one of the three spaces, i.e. the first row space, the second space, and the intermediate space, as necessary. By way of example, FIG. 2 illustrates connections ports 510 and 520 that are formed on the front and side surfaces of the upper header tank 100 to be connected to the inlet or the outlet. The directional arrows indicated in FIG. 2 are the same throughout the specification.

As illustrated in FIG. 3, the upper header tank 100 includes a header member 101 that has a partition wall 101*a* formed in the middle thereof, a tank member 102 that have a cross-sectional structure in which both portions protrude upward and an intermediate portion protrudes downward when viewed from one side (view A) so that the tank member 102 defines a first row upper space 110 and a second row upper space 120 together with the header member 101, and a cover member 103 that is mounted to the intermediate portion of the tank member 102 to define an upper intermediate space 130. Reference numeral 101*b* refers to tube holes into which the tubes 300 are inserted.

The tank member 102 has a first communication hole 141 through which the first row upper space 110 communicates with the upper intermediate space 130, and a second communication hole 142 through which the second row upper space 120 communicates with the upper intermediate space 130.

In addition, a plurality of baffles 400 is installed in the longitudinal direction (in the left and right direction) of the header member 101. The baffles 400 partition the first and second row upper spaces 110 and 120 in the longitudinal direction (in the left and right direction when viewed from the front). The baffles 400 serve to block and switch a flow of refrigerant to form flow passes. The installation positions of the baffles are illustrated in detail in the drawings for explaining embodiments (a first embodiment: FIGS. 5 and 9, and a second embodiment: FIGS. 10 and 13).

FIG. 4 is an exploded perspective view illustrating the lower header tank 200. The lower header tank 200 includes a header member 201 that is connected to the lower ends of the tubes 300, a tank member 202 that is coupled to the header member 201 so that a first row lower space 210 and a second row lower space 220 are defined therebetween, a cover member 303 that is mounted to the lower portion of the tank member 202 to define a lower intermediate space 230, and a plurality of baffles 400 that is installed between the header member 201 and the tank member 202 to form refrigerant passes by partitioning the first and second row lower spaces 210 and 220.

That is, the lower header tank 200 has the same components as the upper header tank 100, and the header members 101 and 201 face each other such that the tubes 300 interconnect both tanks.

Each of the baffles 400 installed in the upper and lower header tanks 100 and 200 may be made of a single plate in which first and second row baffles are integrally formed and thus be installed at the same position in the first and second rows. Alternatively, the first and second row baffles may be formed as separate parts and installed at different positions in the first and second rows.

Hereinafter, a heat exchanger according to a first embodiment of the present invention will be described with reference to FIGS. 5 to 9, wherein the heat exchanger has the double row structure that includes the upper and lower header tanks 100 and 200 each having the three-space structure as described above.

The upper header tank 100 has a first communication hole 141 that is formed in one end between the first row upper space 110 and the upper intermediate space 130, a second communication hole 142 that is formed in the other end between the second row upper space 120 and the upper intermediate space 130, and a refrigerant inlet 143 that is formed at one side of the upper intermediate space 130.

The lower header tank 200 has a first communication hole 241 that is formed in one end between the first row lower space 210 and the lower intermediate space 230, a second communication hole 242 that is formed in the other end between the second row lower space 220 and the lower intermediate space 230, and a refrigerant outlet 243 that is formed at one side of the lower intermediate space 230.

Although the refrigerant inlet and outlet 143 and 243 are illustrated to be formed at the centers of the upper portion of the upper intermediate space 130 and the lower portion of the lower intermediate space 230, respectively, this is by way of illustration only. The installation positions of the refrigerant inlet and outlet 143 and 243 are not limited thereto as long as the upper intermediate space 130 communicates with the lower portion of the lower intermediate space 230. That is, the refrigerant inlet and outlet 143 and 243 may be installed to either of the upper portion of the upper intermediate space 130 and the lower portion of the lower intermediate space 230 or may be installed to any one of both sides of the upper intermediate space 130 and the lower intermediate space 230. The difference between the installation positions of the refrigerant inlet and outlet 143 and 24 (however, the upper intermediate space 130 must communicate with the lower portion of the lower intermediate space 230) causes a slight difference in the time when a refrigerant is introduced into first and second row heat exchangers, but there is no difference in the effect of improving uniformity of temperature distribution by parallel flows and counter flows formed in the first and second rows which will be described later.

The first communication holes 141 and 241 and the second communication holes 142 and 242 are located opposite to each other in the upper and lower header tanks 100 and 200.

In addition, the first communication hole 141 of the upper header tank 100 is diagonal to the first communication hole 241 of the lower header tank 200 in the first row, and the second communication hole 142 of the upper header tank 100 is diagonal to the second communication hole 242 of the lower header tank 200 in the second row.

The first row upper space 110 and the first row lower space 210 are interconnected by the tubes 300 and the second row upper space 120 and the second row lower space 220 are interconnected by the tubes 300.

In the first row, the baffles 400 are alternately installed at a certain distance in the longitudinal direction (in the left and right direction) of the heat exchanger in the first row upper and lower spaces 110 and 210, and the same number of baffles is installed in the first row upper and lower spaces 110 and 210 to form odd passes.

Since the refrigerant inlet 143 is formed in the upper portion (the upper intermediate space 130), the first pass is a downward pass in which a refrigerant flows from top to bottom. Accordingly, when the odd passes including the first pass are formed as a whole, the final pass is also a downward pass in which a refrigerant flows from top to bottom. Thus, the final pass in the first row may be connected to the refrigerant outlet 243 formed in the lower portion (the lower intermediate space 230). FIG. 5 illustrates five passes.

In the second row, the baffles 400 are installed in the same manner. That is, the baffles 400 are alternately installed at a certain distance in the longitudinal direction (in the left and right direction) of the heat exchanger in the second row upper and lower spaces 120 and 220, and the same number of baffles is installed in the second row upper and lower spaces 120 and 220 to form odd passes. However, since the second communication hole 142 is located opposite to the first communication hole 141 as described above, the first pass in the second row is located opposite to the first pass in the first row. However, since the refrigerant inlet 143 is formed in the upper portion similar to the first row, the first pass and the final pass are downward passes in the second row. Thus, the final pass may be connected to the refrigerant outlet 243 formed in the lower portion. FIG. 5 illustrates five passes similar to the first row.

Through such a structure, a refrigerant flows as illustrated in FIGS. 5 to 9 in the first embodiment.

In the first embodiment, a refrigerant is introduced into the upper intermediate space 130 through the refrigerant inlet 143. A portion of the introduced refrigerant is introduced into the first row upper space 110 through the first communication hole 141 formed at one side of the upper intermediate space 130. Then, after the refrigerant flows downward to the first row lower space 210 through the first pass and sequentially flows up and down in the second, third, fourth, and fifth passes, it is introduced into the lower intermediate space 230 through the first communication hole 241 of the lower header tank 200 which is formed at the other side of the first row lower space 210 and is discharged through the refrigerant outlet 243 formed in the lower intermediate space 230.

The remainder of the refrigerant introduced into the upper intermediate space 130 is introduced into the second row upper space 120 through the second communication hole 142 formed at the other side of the upper intermediate space 130. Then, after the refrigerant sequentially flows up and down in the first to fifth passes of the second row heat exchanger, it is introduced into the lower intermediate space 230 through the second communication hole 242 of the lower header tank 200 which is formed at one side of the second row lower space 220 and is discharged through the refrigerant outlet 243 of the lower intermediate space 230 together with the refrigerant passing in the first row heat exchanger.

As described above, the refrigerant is introduced into the upper intermediate space 130 through the refrigerant inlet 143. Then, after the refrigerant is distributed to and introduced into the first and second row heat exchangers through the first and second communication holes 141 and 142 that are formed at opposite sides to each other in the upper intermediate space 130, and flows in the same odd passes in each of the first and second row heat exchangers, the distributed refrigerants are introduced into the lower intermediate space 230 through the first and second communication holes 241 and 242 that are formed at opposite sides to each other in the lower intermediate space 230, and are finally discharged through the refrigerant outlet 243.

In this way, a parallel flow is formed in which the refrigerant is uniformly distributed to the first and second row heat exchangers at the same temperature, and a counter flow is formed in which the refrigerant flows in opposite directions in the first and second row heat exchangers that overlap each other (the refrigerant flows in the right direction (in the direction of the arrow ①) in the first row heat exchanger and flows in the left direction (in the direction of the arrow ②) in the second row heat exchanger). Therefore, a variation in temperature is reduced in an overlapped region and the whole temperature distribution in the heat exchanger is uniformized.

Accordingly, it is possible to improve uniformity of temperature distribution of air discharged to the interior through the heat exchanger.

Hereinafter, a heat exchanger according to a second embodiment of the present invention will be described with reference to FIGS. 10 to 12, wherein the heat exchanger has the double row structure that includes the upper and lower header tanks 100 and 200 each having the three-space structure as described above.

The upper header tank 100 has a first communication hole 141 that is formed in one end between the first row upper space 110 and the upper intermediate space 130, and a second communication hole 142 that is formed in the other end between the second row upper space 120 and the upper intermediate space 130.

Both refrigerant inlet and outlet 111 and 121 are formed in the upper header tank 100. The refrigerant inlet 111 is formed in an end opposite to the first communication hole 141 in the first row upper space 110, and the refrigerant outlet 121 is formed in a portion close to the second communication hole 142 in the second row upper space 120. That is, the refrigerant inlet and outlet 111 and 121 are formed at the same side of the upper header tank 100.

A first communication hole 241 is formed in one end between the first row lower space 210 and the lower intermediate space 230, and a second communication hole 242 is formed in the other end between the second row lower space 220 and the lower intermediate space 230.

The first communication hole 241 in the first row lower space 210 is formed at a side in which the refrigerant inlet 111 is formed in the first row upper space 110, and a refrigerant introduced into the refrigerant inlet 111 flows downward in a first pass and then flows to the lower intermediate space 230 through the first communication hole 241 in the first row lower space 210.

The first row upper space 110 and the first row lower space 210 are interconnected by the tubes 300 and the second row upper space 120 and the second row lower space 220 are interconnected by the tubes 300.

In the first row, the baffles 400 are alternately installed at a certain distance in the longitudinal direction (in the left and right direction) of the heat exchanger in the first row upper and lower spaces 110 and 210, and one more baffles are installed in the first row upper space 110, compared to the first row lower space 210, to form even passes.

Since the refrigerant inlet 111 is formed in the upper portion (the first row upper space 110), the first pass is a downward pass in which a refrigerant flows from top to bottom. Accordingly, when the even passes including the first pass are formed as a whole, the final pass is an upward pass in which a refrigerant flows from bottom to top. Thus, in the final pass in the first row, the refrigerant may be introduced into the upper intermediate space 130 through the first communication hole 141 of the first row upper space 110. FIG. 10 illustrates six passes.

In the second row, the baffles 400 are installed in the same manner. That is, the baffles 400 are alternately installed at a certain distance in the longitudinal direction (in the left and right direction) of the heat exchanger in the second row upper and lower spaces 120 and 220. The same number of baffles is installed in the second row upper and lower spaces 120 and 220 to form odd passes. The first pass in the second row is an upward pass in the second row lower space 220, and the odd passes are formed in the second row. Therefore, the final pass is an upward pass similar to the first pass, and a refrigerant flows to a portion adjacent to the refrigerant outlet 121 of the second row upper space 120 in the final pass. FIG. 10 illustrates five passes.

Through such a structure, a refrigerant flows as illustrated in FIGS. 10 and 13 in the second embodiment.

In the second embodiment, a refrigerant is introduced into the refrigerant inlet 111 formed at one side of the first row upper space 110 and flows downward to the first row lower space 210 through the first pass of the first row heat exchanger. Then, a portion of the refrigerant sequentially flows up and down in the second to sixth passes to be introduced into the first row upper space 110 again, is introduced into the upper intermediate space 130 through the first communication hole 141 formed at one side of the first row upper space 110, flows in an opposite direction in the upper intermediate space 130 to be introduced into the second row upper space 120 through the second communication hole 142 formed at the other side of the upper intermediate space 130, and is then discharged through the refrigerant outlet 121 formed in the second row upper space 120.

The remainder of the refrigerant flowing to the first row lower space 210 via the first pass of the first row heat exchanger is introduced into the lower intermediate space 230 through the first communication hole 241 formed at one side of the first row lower space 210, and flows in an opposite direction in the lower intermediate space 230 to be introduced into the second row lower space 220 through the second communication hole 242 formed at the other side of the lower intermediate space 230. Then, after the refrigerant sequentially flows up and down in the first to fifth passes of the second row heat exchanger, it is introduced into the second row upper space 120 and is then discharged through the refrigerant outlet 121.

As described above, after the first pass of the first row heat exchanger, a portion of the refrigerant flows in the right direction (in the direction of the arrow ①) in the second to sixth passes of the first row heat exchanger, and the remainder passes through the lower intermediate space 230 and then flows in the left direction (in the direction of the arrow ②) in the first to fifth passes of the second row heat exchanger.

That is, there is no significant difference in the time when a refrigerant is introduced into the heat exchanger. Therefore, a parallel flow is formed in which the refrigerant is distributed to and introduced into the first and second row heat exchangers at the almost same temperature, and a counter flow is formed in which the refrigerant flows in opposite directions in the first and second row heat exchangers. Consequently, a variation in temperature is reduced in an overlapped region of the first and second row heat exchangers and the whole temperature distribution in the heat exchanger is uniformized.

Accordingly, since a variation in the temperature of air passing through the heat exchanger is reduced, the temperature distribution of air discharged to the interior is uniformized.

In the second embodiment, the even passes are formed in the first row heat exchanger, wherein the first pass is a downward pass, and the odd passes are formed in the second row heat exchanger, wherein the first pass is an upward pass. Therefore, both the refrigerant inlet and outlet 111 and 121 may be formed in the upper portion of the upper header tank 100.

In addition, since the upper intermediate space 130 allows the refrigerant discharged from the first row heat exchanger to flow in an opposite direction (i.e. toward the refrigerant inlet 111) again, the refrigerant inlet and outlet 111 and 121 may be installed on the same side of the heat exchanger.

Accordingly, it is possible to simplify the layout of pipes connected to the refrigerant inlet and outlet 111 and 121 and to easily perform the connection or disconnection of the pipes.

Although the present invention has been described with respect to the illustrative embodiments, it will be apparent to those skilled in the art that various variations and modifications may be made without departing from the spirit and scope of the invention as defined in the following claims.

INDUSTRIAL APPLICABILITY

The present invention relates to a heat exchanger for a vehicle in which air passing therethrough has a uniform temperature distribution.

The invention claimed is:

1. A heat exchanger for a vehicle, comprising:

an upper header tank comprising a first row upper space, a second row upper space, and an upper intermediate space having first and second communication holes and formed therebetween;

a lower header tank comprising a first row lower space, a second row lower space, and a lower intermediate space having first and second communication holes and formed therebetween;

a first row heat exchanger formed by connecting the first row upper space to the first row lower space using a plurality of tubes;

a second row heat exchanger formed by connecting the second row upper space to the second row lower space using a plurality of tubes; and a plurality of baffles installed in the first row upper space, the second row upper space, the first row lower space, and the second row lower space to form refrigerant passes, wherein:

a parallel flow is formed in which a refrigerant is distributed to the first row heat exchanger and the second row heat exchanger; and a counter flow is formed in which the refrigerant flowing from an introduction port to a discharge port flows in opposite directions in each of the first row heat exchanger and the second row heat exchanger.

2. The heat exchanger according to claim 1, wherein the introduction port is a refrigerant inlet formed in the upper intermediate space, the discharge port is a refrigerant outlet formed in the lower intermediate space, the refrigerant is introduced into the refrigerant inlet and is then distributed to and introduced into the first row upper space and the second row upper space through the first and second communication holes formed at opposite sides in the upper intermediate space, and the distributed refrigerants flow in opposite directions in the first row heat exchanger and the second row heat exchanger to flow to the first row lower space and the second row lower space, are introduced from the first row lower space and the second row lower space into the lower intermediate space through the first and second communication holes and formed at opposite sides in the lower intermediate space, and are discharged through the refrigerant outlet.

3. The heat exchanger according to claim 2, wherein the refrigerant inlet is formed at one side of an upper portion in the upper intermediate space, and the refrigerant outlet is formed at one side of a lower portion in the lower intermediate space.

4. The heat exchanger according to claim 2, wherein the refrigerant inlet is formed at any one of both sides in the upper intermediate space, and the refrigerant outlet is formed at any one of both sides in the lower intermediate space.

5. The heat exchanger according to claim 2, wherein:

the baffles are alternately installed at a certain distance in the first row upper space and the first row lower space in the first row heat exchanger so that the same number of baffles is installed in the first row upper space and the first row lower space to form odd refrigerant passes; and the baffles are alternately installed at a certain distance in the second row upper space and the second row lower space in the second row heat exchanger so that the same number of baffles is installed in the second row upper space and the second row lower space to form odd refrigerant passes.

6. The heat exchanger according to claim 1, wherein the introduction port is a refrigerant inlet formed in the upper intermediate space, the discharge port is a refrigerant outlet formed in the lower intermediate space, the refrigerant is introduced into the refrigerant inlet and flows downward to the first row lower space through a first pass of the first row heat exchanger, a portion of the refrigerant flows in one direction along refrigerant passes of the first row heat exchanger to flow upward to the first row upper space, flows to the upper intermediate space through the first communication hole formed at one side in the upper intermediate space, is introduced into the second row upper space through the second communication hole formed at an opposite side in the upper intermediate space, and is then discharged to the refrigerant outlet formed in the second row upper space, and the remainder of the refrigerant is introduced into the lower intermediate space through the first communication hole formed at one side in the lower intermediate space, is introduced into the second row heat exchanger through the second communication hole formed at an opposite side in the lower intermediate space to flow along refrigerant passes of the second row heat exchanger in a direction opposite to the refrigerant flow in the first row heat exchanger, and then flows upward to the second row upper space to be discharged through the refrigerant outlet.

7. The heat exchanger according to claim 6, wherein the refrigerant inlet and the refrigerant outlet are formed at the same side in the first row upper space or the second row upper space.

8. The heat exchanger according to claim 6, wherein:

the baffles are alternately installed at a certain distance in the first row upper space and the first row lower space in the first row heat exchanger so that one more baffles are installed in the first row upper space, compared to the first row lower space, to form even refrigerant passes; and the baffles are alternately installed at a certain distance in the second row upper space and the second row lower space in the second row heat exchanger so that the same number of baffles is installed in the second row upper space and the second row lower space to form odd refrigerant passes.

* * * * *